United States Patent [19]

Jarman

[11] 4,341,104

[45] Jul. 27, 1982

[54] PRESS BRAKE PLATE LIFTER TABLE

[76] Inventor: David J. Jarman, PO 181/RR #3, Aurora, Ind. 47001

[21] Appl. No.: 95,335

[22] Filed: Nov. 19, 1979

[51] Int. Cl.[3] ..... B21D 5/01

[52] U.S. Cl. ..... 72/389; 72/419

[58] Field of Search ..... 72/389, 386, 461, 419, 72/426, 428, 421

[56] References Cited

U.S. PATENT DOCUMENTS

| | | | |
|---|---|---|---|
| 2,922,459 | 1/1960 | Beebe | 72/419 |
| 3,715,907 | 2/1973 | Hamada | 72/419 |
| 3,748,890 | 7/1973 | Thatcher | 72/386 |
| 3,855,840 | 12/1974 | Kawano | 72/389 |
| 3,861,193 | 1/1975 | Morguson | 72/389 |
| 4,114,418 | 9/1978 | Jarman | 72/386 |

FOREIGN PATENT DOCUMENTS

| | | | |
|---|---|---|---|
| 2343674 | 3/1975 | Fed. Rep. of Germany | 72/389 |
| 367928 | 1/1973 | U.S.S.R. | 72/389 |

*Primary Examiner*—Gene Crosby
*Attorney, Agent, or Firm*—Alter and Weiss

[57] ABSTRACT

An improved press brake plate lifter comprising a pneumatically operated support surface or table wherein the angle of the support surface can be accurately pre-adjusted to match the angle of the die. The pre-adjusted support surface is rotatably lifted simultaneously with the movement of the ram to preclude any back bending of the plate being formed.

11 Claims, 5 Drawing Figures

PRESS BRAKE PLATE LIFTER TABLE

This invention relates generally to material support means; and more particularly, to press brake plate lifters for raising and supporting sheet metal stock during press brake bending operations.

As is well known, press brakes are used to form lips, edges and flanges on sheet stock. The press brakes commonly have a lower stationary die and an upper ram adapted to meet the lower die and form the metal therebetween. The die and ram are formed with mating surfaces cut to the angle to which the flat stock is to be bent.

When long, heavy pieces of flat stock are worked, there is a tendency to form unwanted secondary back-bends in the flat stock, unless the stock is properiy supported. To effectively form the flange without causing any secondary bends, the flat stock must be raised and supported as the die and ram meet to effect a clean precise bend only at the desired location.

Attempts have been made in the past to design material lifting apparatus adequate to support large pieces of flat stock during press brake operations. One method is to support the flat stock on a self-aligning table which is centrally pivoted so as to align with and support the flat stock being bent by the press brake.

Other arrangements in the prior art are those shown, for example, in U.S. Pat. Nos. 2,922,459 and 3,861,193 wherein the support surface is forced upward at a slant until it matches the angle of the die so as to afford support to the stock material during the forming operation.

My own U.S. Pat. No. 4,114,418 also shows material handling means which forces the support surface upward at a slant to align with an angular surface of the stationary die and fully supports the stock material during forming. Thus, for example, when the flange being formed is at 90 degrees to the main plate, then the angle of the die and the support surface are 45 degrees to the horizontal.

Many times the dies of the press brake are changed in order to form a different angle of the flange being formed. Most of the prior art devices had no way of readily adjusting the support table to accomodate the different angles of the stationary die. In using the support tables in such circumstances, back-bends often resulted.

Other prior art devices had extremely complicated ways of varying the angle of the support table to accomodate different dies, such as for example, actually removing the cylinders and moving them to new locations.

Accordingly, an object of the present invention is to provide new and unique press brake plate support tables.

Yet another object of the present invention is to provide press brake plate lifters which support the sheet material being formed in the press brake completely during the forming operation and which are readily adjustable for accomodating different forming angles.

Yet another object of the present invention is to provide material handling equipment for use with press brakes wherein the material handling equipment supports the plate stock during the forming operation by raising the plate stock at angles conforming with the angle of the die so as to support the plate stock on a plane matching that of the forming die.

A related object of the present invention is to provide hydraulic cylinder means for moving the plate material supporting surface during the forming operation from a horizontal position to a position at an angle to the horizontal.

Still another object of the present invention is to provide means for readily and accurately moving the hydraulic cylinders to vary the angle at which the plate material is held during the forming operation.

In accordance with a preferred embodiment of the present invention the table top plate support surface is normally in a horizontal position. As the ram descends to form the sheet material in the die, the support surface is lifted by a hydraulic cylinder means operating through arcuate members. The angle that the support surface assumes is varied by positioning the hydraulic cylinder means along a track.

The arcuate members ride on rollers and are retained a given horizontal distance from the forming die. The movement of the hydraulic cylinder varies the distance that the arcuate members move and thereby varies the angle that the support surface assumes responsive to the operation of the ram.

The above mentioned and other and further objects of the present invention will be best understood by making reference to the accompanying drawings, wherein.

Figure 1:
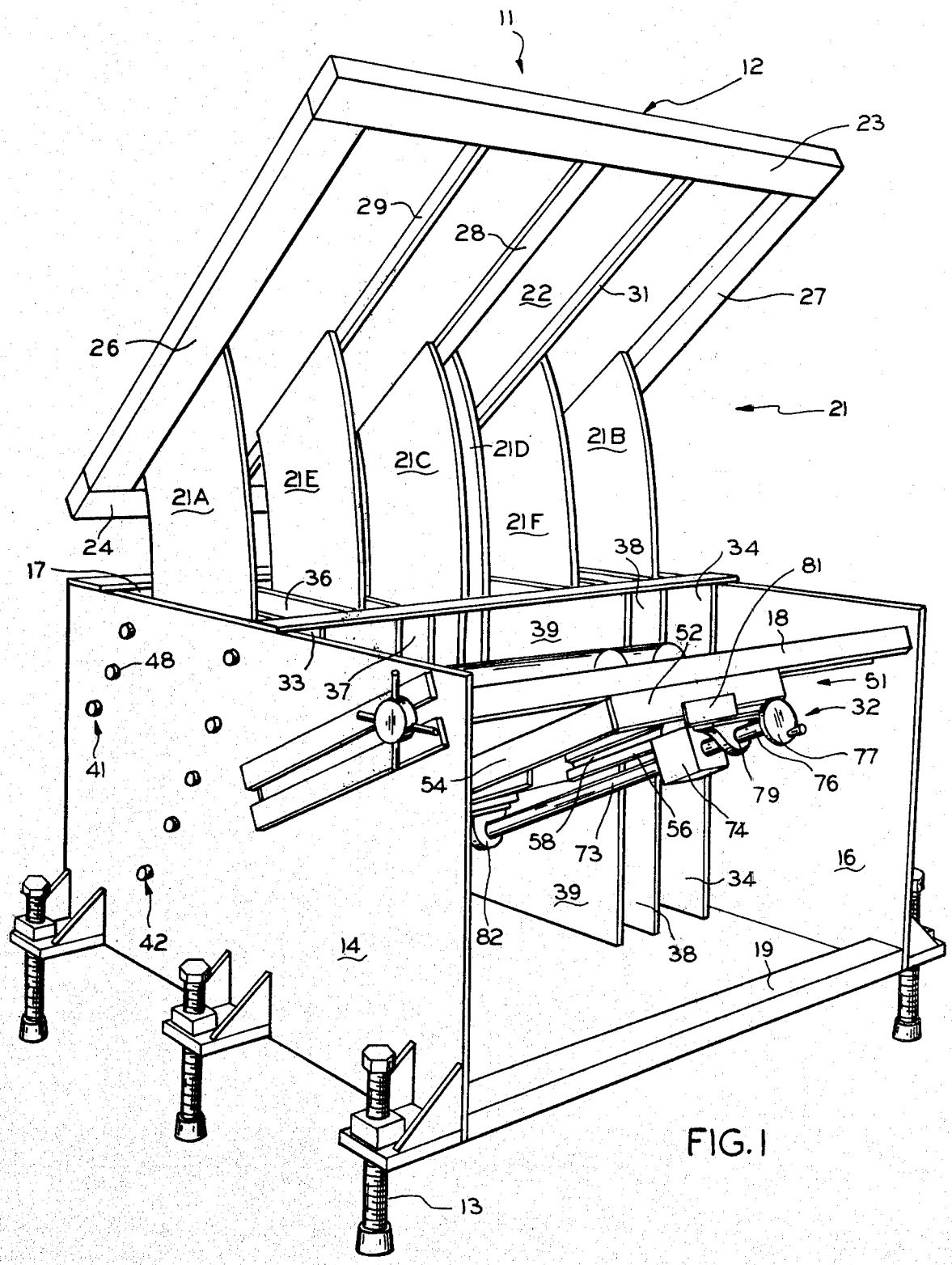
FIG. 1 is a pictorial drawing of the improved press brake plate lifter table showing the support surface at a maximum angle to the horizontal.

In FIG. 1 the press brake table 11 is shown as comprising a sheet stock support surface 12 angularly extending from a base unit 13 mounted on height adjustment screw standards, such as standard 15. The base unit 13 comprises a boxlike wall structure having side walls 14 and 16 and a front wall 17.

Means are provided (not shown) for attaching the plate lifter table 11 to a press brake. These means may be those ordinarily used in physically attaching the plate lifter table to the press brake, as well as hydraulically attaching the hydraulics of the table to operate with the hydraulics of the press brake.

Extending between the walls 14 and 16 are upper and lower cross beams 18 and 19. The support surface 12 is shown as resting on a plurality of arcuate members 21. The support surface 12 comprises a flat surface 22 supported by a plurality of beams forming rectangles. More particularly, there are shown beams 23 and 24 which extend the width of the support surface and beams 26 and 27 which extend peripherally normal to the beams 23 and 24. A center beam 28 is also shown along with beams 29 and 31 parallel to the center beam.

The longitudinally extending beams have an arcuate member attached thereto by any well known means, such as by welding, for example. Thus, attached to longitudinal beam 26 is arcuate member 21A; attached to longitudinal beam 27 is arcuate member 21B; attached to longitudinal beam 28 are two arcuate members 21C and 21D. Arcuate members 21E and 21F are attached to longitudinal beams 29 and 31, respectively.

Figure 2:
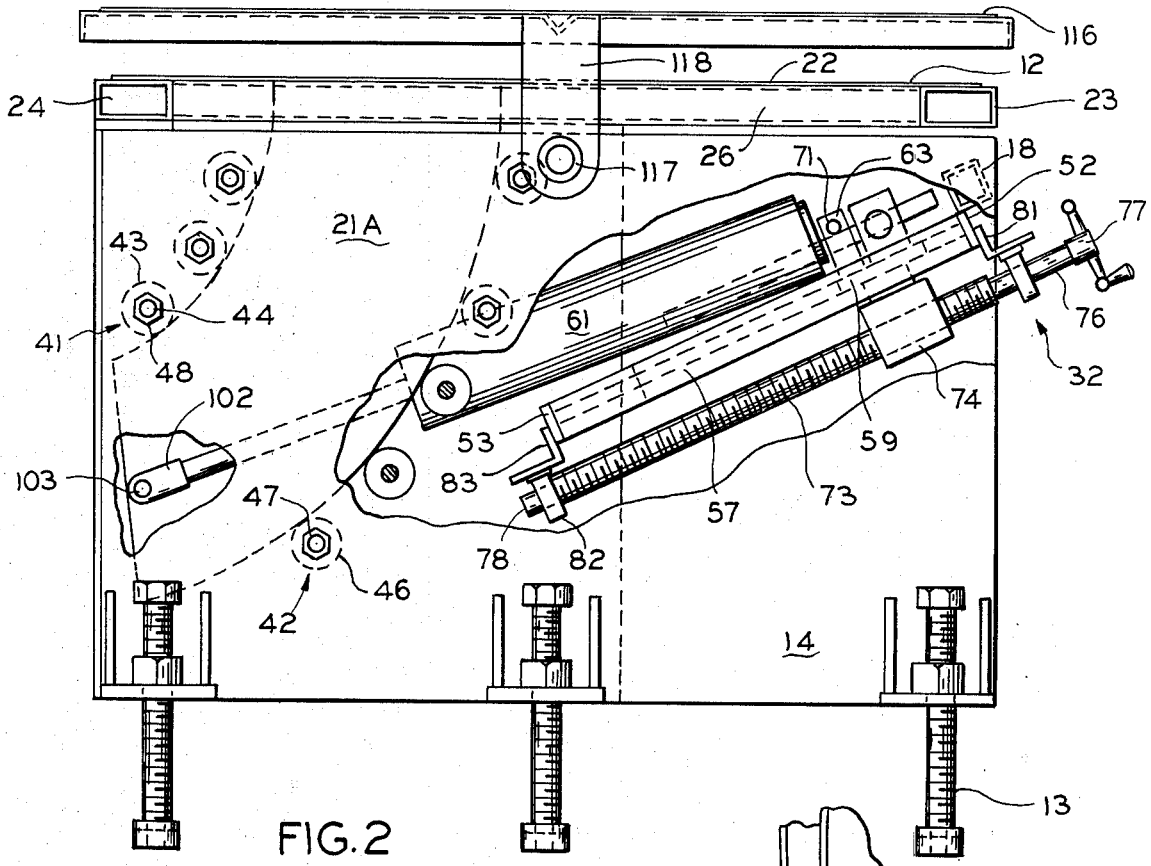
FIG. 2 is a side view of the table of FIG. 1 showing the support surface horizontally disposed with the side wall partially removed to show details of the table angle adjustment mechanism.

Means, such as a table angle adjustment mechanism 32, are provided for moving the support surface 12 from a horizontal position, as shown in FIG. 2, to a desired preset angular position, such as is shown in FIG. 1. Each of the arcuate members 21, except for 21C and 21D, moves on retaining and bearing means mounted between a pair of parallel bulkheads, including outer walls 14 and 16. Thus, arcuate member 21A moves on rollers mounted between wall 14 and bulkhead 33; arcuate member 21B moves on rollers mounted between outer wall 16 and bulkhead 34; arcuate member 21E moves on rollers mounted between bulkheads 36 and 37; arcuate member 21F moves on rollers mounted between parallel vertical bulkheads 38 and 39.

The rollers are rotatably mounted on shafts which are permanently affixed to the walls and bulkheads. The shaft ends are seen, for example, in FIG. 1 at 41 and 42 defining the forward and aft peripheries of the arcuate members.

The rollers are better seen in FIG. 2 where, for example, a bearing roller wheel 43 is shown attached to the bottommost shaft 44 of the shafts 41. Similarly, a roller 46 is shown on the bottommost shaft 47 of shafts 42. A fastener 48 is shown holding shaft 44 in place. This is the fastener, for example, that is seen on the bottommost shaft 41 in FIG. 1.

The support surface angle mechanism 32 comprises a frame unit attached to the cross beam 18 and bulkheads 39 and 37. As is apparent, the frame unit is at an angle to the horizontal. The frame unit comprises transverse members 52 and 53 and oppositely disposed, spaced apart, parallel longitudinal members 54 and 56. The longitudinal members 54 and 56 have oppositely disposed parallel slots, such as slots 57 and 58.

Riding in the slots is a cylinder bearing plate 59. Rising from plate 59 are means, such as apertured standards 63 and 64 for pivotally attaching hydraulic cylinders 61 and 62, respectively, to the plate. The hydraulic cylinders 61 and 62 each have yoke means, such as arcuate members 66 and 67, extending longitudinally from cylinder 62 and apertured members 68 and 69 longitudinally extending from cylinder 61. Rods, such as rods 71 and 72, extend through the apertures on the yokes and on the standards to pivotally mount cylinders 61 and 62, respectively, to cylinder bearing plate 59.

Means are provided for moving plate 59 in slots 57 and 58. More particularly, the plate 59 is attached to a threaded rod 73 through means, such as threaded block 74. The threaded rod 73 has integral thereto handle non-threaded section 76 terminating in a handle 77. The opposite end of the threaded rod 73 also has a non-threaded section 78.

The section 76 passes through a downwardly extending apertured bracket 79. The bracket 79 is attached to an L-shaped bracket 81 which in turn is fastened to beam 52 by any well known means, such as by welding. Similarly, the end 78 passes through the apertured bracket 82 which in turn is fastened to a second L-shaped bracket 83 attached to transverse beam 53 by any well known means, such as by welding. Thus, the rotating of handle 77 causes threaded rod 73 to rotate and move the threaded block member 74 and plate 79 along with the attached cylinders 61 and 62.

Means are provided for firmly locking cylinder bearing plate 59 where it is set. More particularly, plate 59 has a pair of holding apertured blocks 84 and 86 affixed thereto. A locking rod 87 extends through the holding blocks 84 and 86 and also through slots 88 and 89 in walls 14 and 16, respectively. The slots 88 and 89 are shown as having reinforcing plates, such as plates 91 and 92 at the top and bottom, respectively, of each of the slots.

Figure 3:
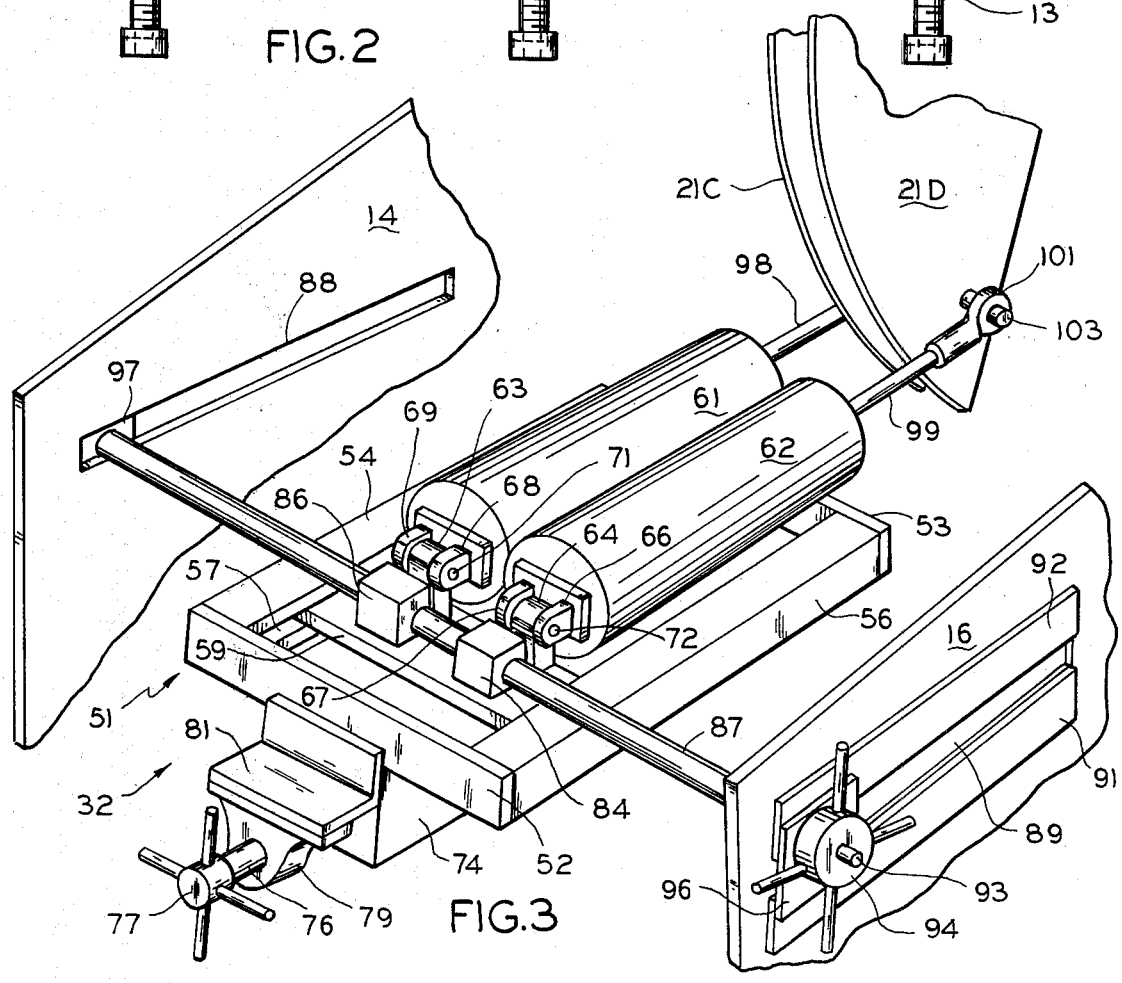
FIG. 3 is a pictorial view of the table angle adjustment mechanism.

Rod 87 terminates in threaded portions, such as threaded portion 93, shown in FIG. 3. A locking means, including a threaded handle 94 fits over and meshes with the threaded portion 93. Turning the handle, such as handle 94, clockwise forces locking plates, such as plates 96 and 97, against the reinforcing plates 91 and 92 to lock plate 59 in the position set by operating handle 77 and threaded rod 73.

The pistons, such as piston 98 and 99, extending from cylinders 61 and 62, respectively, are pivotally attached to arcuate members 21C and 21D in any well known manner. For example, the pistons are shown terminating in apertured members 101, shown in FIG. 3, and 102, shown in FIG. 2. The apertured members fit over rod 103 which extends between and through arcuate members 21C and 21D.

The position of cylinder bearing plate 59 determines the angle at which the support surface rests, after the cylinders are operated to extend the pistons. The cylinders are operated responsive to the operation of the ram of the press brake. Thus, if the die of the press brake is changed, the handle 77 is operated to vary the angle at which the support surface rests to match the angle of the new die; thereby, fully supporting the stock material throughout the press brake operation.

Figure 4A:
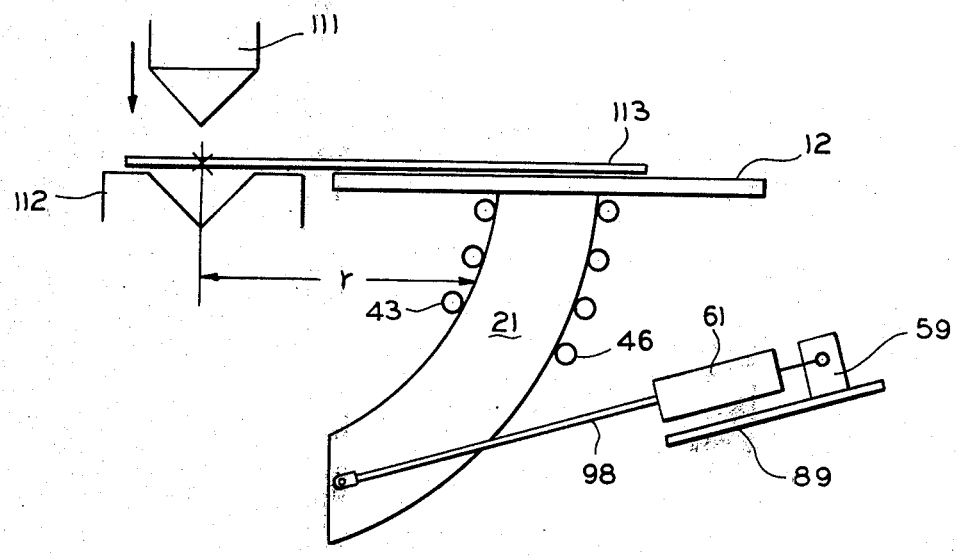
FIGS. 4A and 4B are schematic showings of the table angle adjustment in the unoperated and operated positions, respectively.
Figure 4B:
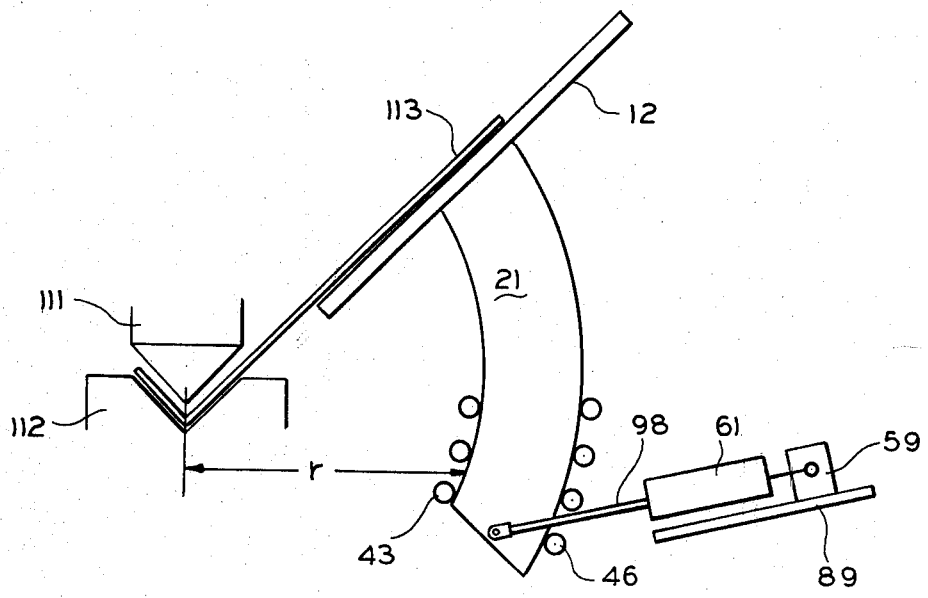

FIGS. 4A and 4B schematically show the operation of the press brake plate lifter table in combination with the press brake. More particularly, there is shown, for example, the ram 111, the stationary die 112 of the press brake. The sheet material support surface 12 is shown in the horizontal position prior to the operation of the ram in FIG. 4A. Some sheet material 113 is shown supported by surface 12 and extending into the die of the press brake.

The support surface 12 rests on the arcuate members 21 which are coupled through piston 98, for example to cylinder 61. The cylinder is pivotally fixed to cylinder bearing plate 59 which is selectively moved along an angled slot 89. The arcuate member 21 is at a fixed radius r from the center of the die regardless of the position of the arcuate member 21. In other words, the plate moves along the radius r as the piston 98 is forced into the cylinder 61.

The rollers 43 and 46, retain the arcuate member 21 in location, the distance r from the center of the die. Thus, once the cylinder bearing plate 59 is positioned using the handle 77, the surface 12 will always assume the same angular disposition caused by the action of the cylinder shortening the piston. The cylinder is hydraulically attached to operate with the ram motivating hydraulics in any well known manner.

FIG. 4B shows the position of the various components after the forming operation. Thus, in FIG. 4B the ram 111 is on the way up; the plate material 113 has already been formed in the stationary die 112; the piston 98 is shortened; arcuate member 21 has been moved upward in its path that is restricted by the rollers between the walls or bulkheads to assume an angle matching the angle of the staionary die 112 so as to continuously retain support of plate material 113. If the die 112 is changed, the position of plate 59 and consequently cylinder 61 is varied to be sure that the plate support surface 12 assumes a pitch or an angular position matching the angle of the new die.

In FIG. 2 an optional self-aligning top 116 is shown in position mounted to pivot axis 117 through bracket 118. In operation the press brake plate lifter table is attached to the press brake ideally such that the distance between the die of the press brake and the front of the arcuate plates is equal to the radius of the arcuate member 21. In a preferred embodiment that is 16 inches.

The press brake plate lifter table is then adjusted using adjustable standards or legs 13. The adjustable legs of the press brake lifter table are also manipulated so as to assure that the support plate of the press brake lifter is level.

Afterwards, the locking handles, such as handle 94, are loosened and the table angle adjustment handle 77 is operated to move the cylinder bearing plate 59 to a position so that the final operated position of the support surface 12 matches the angle of the die. The locking handles 94 are then operated to place the locking plates against the slot reinforcing plate and lock plate 59 in position.

At this time, the ram is operated and the position of the support surface 12 is checked to be sure that it does align with the angle of the die. Then plate material is put into position on top of the support surface, placed to extend into the press brake. The press brake is operated with the press brake plate lifter table continuously supporting and, in fact, aiding in the forming of the plate material.

While the principles of the invention have been described above in connection with specific apparatus and applications it is to be understood that this description is made by way of example only and not as a limitation on the scope of the claims.

What is claimed is:

1. In a press brake plate lifter table of the type having a support surface for supporting material to be formed in said press brake, said support surface having a horizontal position and an angular position, and hydraulic cylinder means for moving said surface between said horizontal position and said angular position, the improvement comprising:

means for moving said hydraulic cylinder means toward or away from said support surface to vary said angular position, said moving means including threaded rod means;

handle means for rotating said threaded rod means;

plate means threadably associated with said rod means and moving responsive to the rotation of said rod means; and means for pivotally attaching said hydraulic cylinder means to said plate means.

2. The press brake plate lifter table of claim 1 wherein the improvement is further characterized in this that linkage means are provided between said hydraulic cylinder means and said support surface, said linkage means being arcuately shaped, affixed to said support surface and pivotally attached to said hydraulic cylinder means.

3. A press brake lifter table comprising a support surface for supporting material to be formed in a press brake, said support surface having a first position and a final position;

hydraulic cylinder means;

said hydraulic cylinder means having a cylinder rod extendable therefrom, means to link said hydraulic cylinder means to said support surface for moving said support surface between said first position and said final position;

said final position being at an angle to the horizontal; and means to vary the angle to the horizontal of said support surface in said final position, said varying means including means for changing the position of said hydraulic cylinder means with respect to said link means;

said moving means including a carriage to which said hydraulic cylinder means is pivotally attached; and means to move said carriage toward or away from said link means.

4. The press brake plate lifter table of claim 3 wherein said moving means includes threaded rod means, handle means for rotating said threaded rod means, said carriage being a threaded plate means and for moving responsive to the rotation of said threaded rod means, and means for pivotally attaching said hydraulic cylinder means to said threaded plate means.

5. The press brake plate lifter table of claim 4 and means for locking said threaded plate means in the position set by the rotation of said threaded rod means.

6. The press brake plate lifter table of claim 5 wherein said threaded plate means moves in slot means slanted to the horizontal.

7. The press brake plate lifter table of claim 4 wherein said link means comprises arcuate member means affixed to said support surface.

8. The press brake plate lifter table of claim 7 including retaining bearing means to retain said arcuate member means in a given path and provide bearing surface means for said arcuate member means to move along when moved by said hydraulic cylinder means.

9. The press brake plate lifter table of claim 8 wherein said table is coupled to said press brake so that the distance between the center of the die of the press brake and the front surface of said arcuate member is equal to the radius of the front surface of said arcuate member means.

10. The press brake plate lifter table of claim 9 wherein means are provided for adjusting the height and level of said table.

11. The apparatus as recited in claim 7 wherein said arcuate member means operates to move said work surface to said final position when said cylinder rod is drawn into said hydraulic cylinder means.

* * * * *